US005232426A

United States Patent [19]

Van Straaten

[11] Patent Number: 5,232,426

[45] Date of Patent: Aug. 3, 1993

[54] EXERCISING MACHINE

[75] Inventor: Willem J. Van Straaten, Sandhurst, South Africa

[73] Assignee: Verimark CC, Transvaal, South Africa

[21] Appl. No.: 794,577

[22] Filed: Nov. 19, 1991

[30] Foreign Application Priority Data

Oct. 24, 1991 [ZA] South Africa ..... 91-8483

[51] Int. Cl.[5] ..... A63B 21/02; A63B 21/04; A63B 26/00

[52] U.S. Cl. ..... 482/123; 482/126; 482/130; 482/139; 482/142; 482/908

[58] Field of Search ..... 482/121, 123, 126, 129, 482/130, 139, 142, 148, 908

[56] References Cited

U.S. PATENT DOCUMENTS

| | | | |
|---|---|---|---|
| 1,623,670 | 4/1927 | Frankenfeld | 482/123 |
| 1,623,671 | 4/1927 | Frankenfeld | 482/123 |
| 2,128,332 | 8/1938 | Schollmeyer . | |
| 3,558,131 | 1/1971 | Dragon . | |
| 3,664,666 | 5/1972 | Lloyd | 482/121 |
| 3,716,230 | 2/1973 | Mark | 482/139 |
| 3,761,081 | 9/1973 | Simmons | 482/142 |
| 3,770,267 | 11/1973 | McCarthy . | |
| 3,782,717 | 1/1974 | Berlin | 482/139 |
| 3,893,667 | 7/1975 | Snyder, Jr. et al. . | |
| 4,198,044 | 4/1980 | Holappa | 482/142 |
| 4,465,274 | 8/1984 | Davenport . | |
| 4,478,413 | 10/1984 | Siwula | 482/123 |
| 4,521,009 | 6/1985 | Pomeroy | 482/60 |
| 4,609,192 | 9/1986 | Bratcher | 482/142 |
| 4,632,390 | 12/1986 | Richey . | |
| 4,634,119 | 1/1987 | Pesthy . | |
| 4,653,751 | 5/1987 | Green . | |
| 4,848,741 | 7/1989 | Hermanson . | |
| 4,911,438 | 3/1990 | Van Straaten . | |
| 4,949,958 | 8/1990 | Richey . | |
| 4,960,277 | 10/1990 | LaRossa et al. | 482/142 |

FOREIGN PATENT DOCUMENTS

| | | |
|---|---|---|
| 0208208 | 1/1987 | European Pat. Off. . |
| 2403089 | 4/1979 | France . |
| 2192343 | 1/1988 | United Kingdom . |
| 87/01046 | 2/1987 | World Int. Prop. O. . |
| 81/02524 | 9/1989 | World Int. Prop. O. . |

*Primary Examiner*—Richard J. Apley
*Assistant Examiner*—Lynne A. Reichard
*Attorney, Agent, or Firm*—Burns, Doane, Swecker & Mathis

[57] ABSTRACT

The exercising machine has support legs (12), a pair of support members (16) and one or more resistance elements (22) in the form of elastic bands. The legs and support members are pivotally interconnected. The nature of the pivotal interconnection is such that the legs and support members can assume operative and inoperative states. In the operative state the legs define a stand and the support members are supported by the stand. The support members can themselves be pivoted relative to the stand to various inclinations to provide different forms of support for a user, the user when supported by the support members being able to exercise against the resistance offered by the resistance element. In the inoperative state, the legs and support members are pivoted together so as to be parallel or nearly parallel with one another, so the machine is extremely compact in this state.

20 Claims, 5 Drawing Sheets

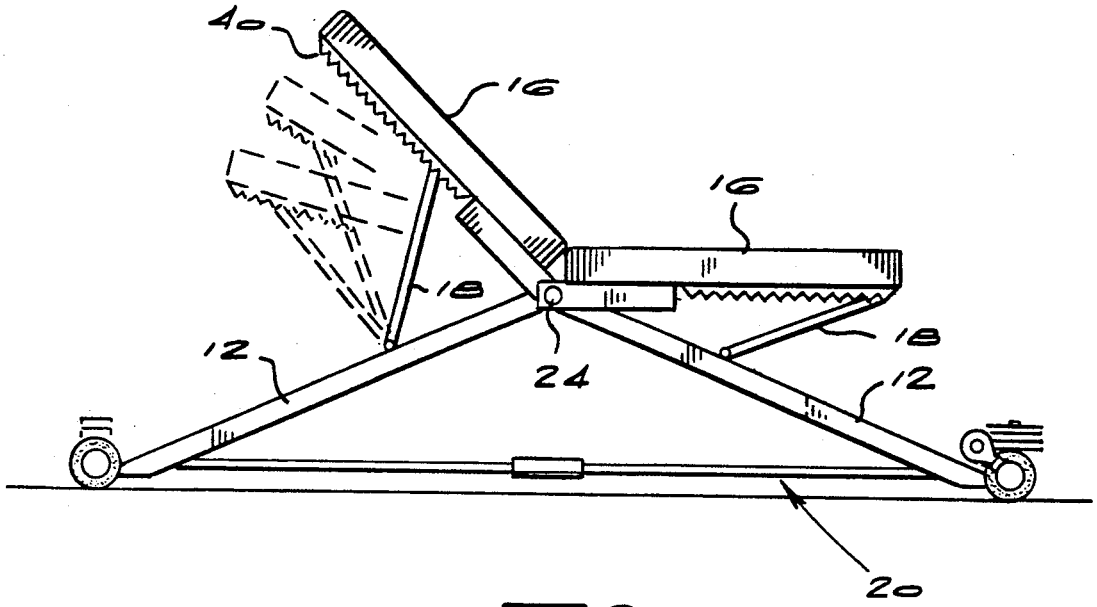
FIG 2
FIG 3
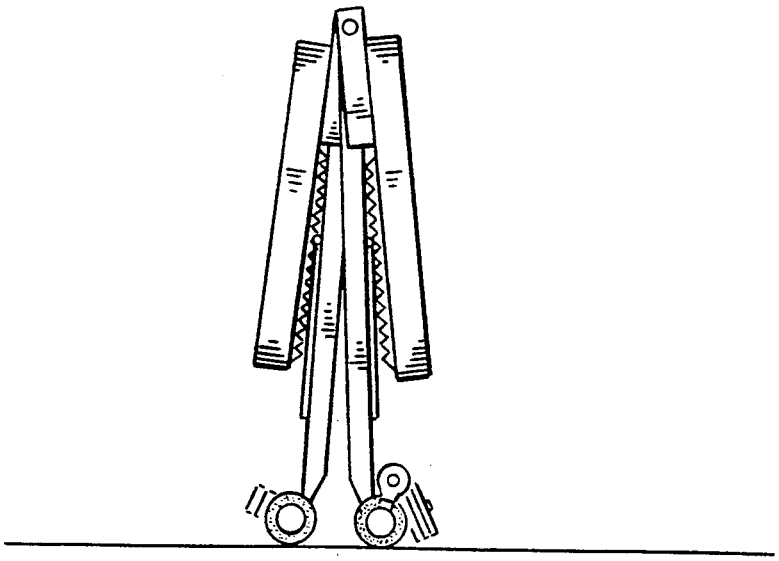

EXERCISING MACHINE

BACKGROUND TO THE INVENTION

This invention relates to an exercising machine.

While many different types of exercising machines are available, very few have the facility for a wide range of exercises while being capable of being stored compactly.

SUMMARY OF THE INVENTION

The invention provides an exercising machine comprising support legs, a pair of support members and at least one resistance element, the legs and support members being pivotally interconnected in such a manner as to be movable between:

a) an operative state in which the legs define a stand and the support members are supported by the stand, the support members themselves being movable pivotally relative to the stand to various inclinations to provide different forms of support for a user, the user when supported by the support members being able to exercise against the resistance offered by the resistance element; and b) a compact, inoperative state in which the legs and support members are pivoted together so as to be parallel or nearly parallel with one another.

There is preferably a pair of legs. In one embodiment the legs and support members are pivoted to one another about a single, common, pivotal axis. In another, preferred embodiment, the legs are pivoted to one another and the support members are pivoted to the respective legs.

The machine may include pivotal stays for supporting the support members, relative to the legs, at selected support member inclinations.

For stability, the legs preferably carry transverse, ground-engaging feet at their ends.

To increase the versatility of the machine, it is also preferred that there are two or more resistance elements in form of elastic bands of varying elasticity. In the most preferred embodiments, there are three resistance elements.

The machine may also have handles and/or ankle straps which are selectively engagable with any one or more of the elastic bands, thereby to vary the resistance against which the user can exercise.

BRIEF DESCRIPTION OF THE DRAWINGS

The invention will now be described in more detail, by way of example only, with reference to the accompanying drawings in which:

FIG. 2 shows a side view of the exercising machine of FIG. 1, in the operative state;

FIG. 3 shows a side view of the exercising machine of FIGS. 1 and 2, in an inoperative state;

DESCRIPTION OF EMBODIMENTS

Figure 1:
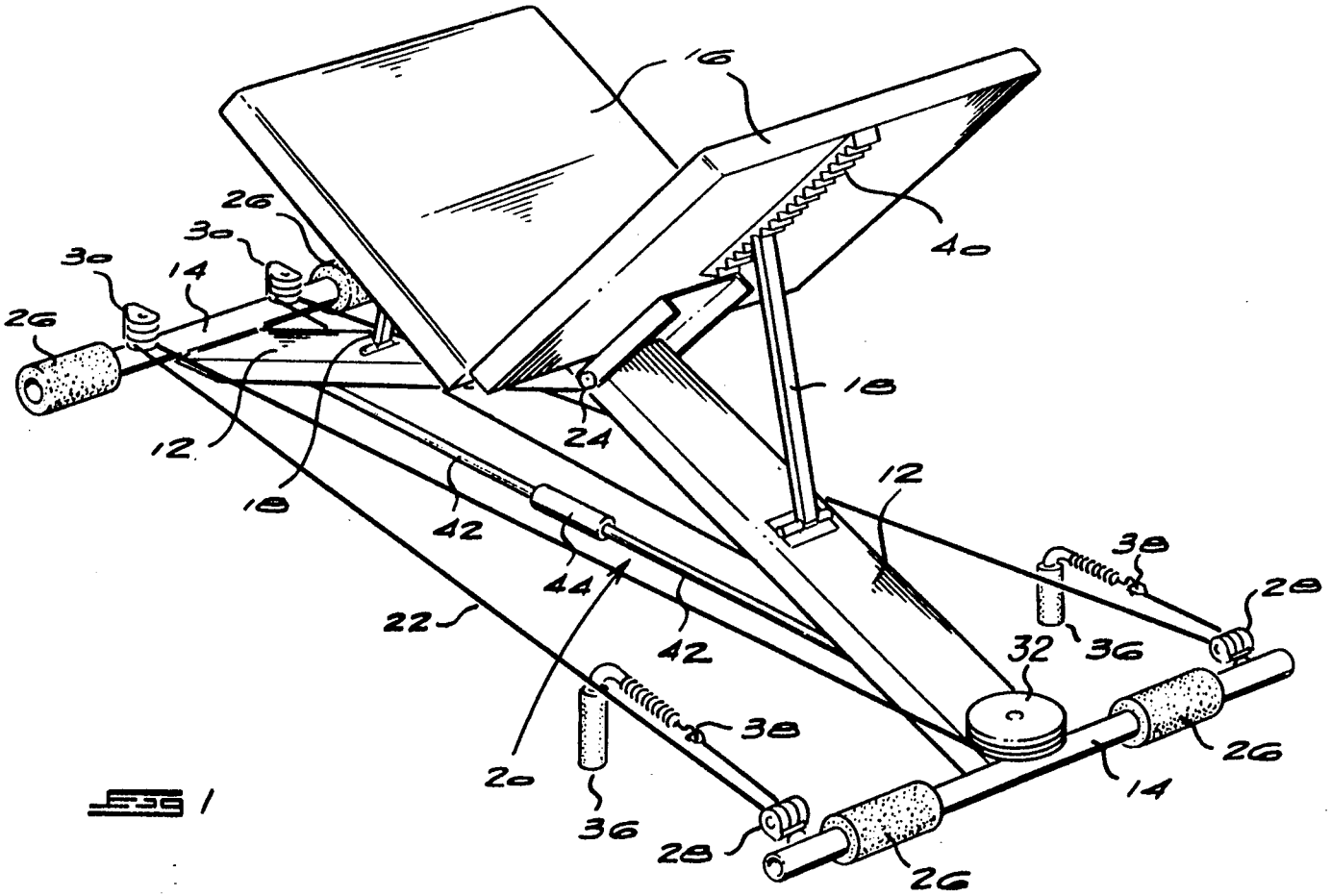
FIG. 1 shows a perspective view of a first embodiment of exercising machine of the invention in an operative state.

The exercising machine 10 illustrated in FIGS. 1 to 3 has a pair of legs 12, a pair of feet 14, a pair of padded support members 16, a pair of stays 18, a brace 20 and an elastic resistance element 22. The legs 12 and the support members 16 are pivotally interconnected at a single axle 24.

The legs 12 are of channel cross-section, with the width of one leg being somewhat less than that of the other leg. The feet 14 are in form of bars connected transversely to the ends of the legs 12. The bars have padded ends 26. The respective bars carry pulley blocks 28, 30 and a single pulley 32, with three grooves, is provided on one of the feet as illustrated. The resistance element 22, constituted by a length of elastic cord, is looped about the pulleys as shown. For clarity of illustration, the elastic cord is only illustrated in FIG. 1. Also, it is to be appreciated that in practice, there will be three such elastic cords, each entrained about the relevant pulleys in the pulley blocks 28 and 30 and about the relevant groove in the single pulley 32. The three cords will be of varying elasticity.

Handles 36 are provided at the ends of the resistance elements. Each handle has a hook 38 which can be engaged with any one or any chosen combination of the resistance elements, thereby affording a user of the exercising machine 10 a variety of different elastic resistances against which to exercise.

The stays 18 are pivoted to the legs 12 and are engagable, in the operative state of FIGS. 1 and 2, with a chosen depression in a ratchet 40 provided on the underside of the corresponding support member 16. As illustrated on the left hand side of FIG. 2, the inclination of each support member relative to the horizontal can be varied through a wide-range, with the stays 18 in each case providing the necessary anchorage and support for the support member at the chosen inclination.

The brace 20 is formed from two bars 42 which are pivoted to the respective legs 12 at one end and which are hinged to one another at the other end. To lock the bars 42 in the bracing position of FIGS. 1 and 2, a sleeve 44 is provided. With the bars aligned at the midpoint hinge, the sleeve is slipped over the hinge to prevent relative hinging movement between the bars. In the locked position, the brace 20 maintains the spacing of the feet.

In the operative position of FIGS. 1 and 2, the user can arrange the support legs 12 form a downwardly open acute angle, and the support members 16 are pivotably mounted adjacent the highest point of the angle. The support members 16 to form any one of a number of different support configurations such as a seat with one support member generally horizontal and the other upright, a bench with both support members horizontal, or any intermediate configuration. In any one of the chosen support configurations of the support members, a user supported by the support members manually grasps the handles and then performs various exercises by alternately stretching and then releasing the chosen elastic cord or cords.

The handles can be replaced by, for instance, ankle straps by means of which the user can engage the chosen cord or cords with his ankles, thereby broadening the range of possible exercises that can be performed in each support member configuration.

After an exercise session the machine 10 can be folded up compactly for storage or transportation. This is achieved by slipping the sleeve 44 off the hinge between the bars 42, detaching the stays 18 from the ratchets 40 and folding them down against their legs, and then folding the bars 42, support members and legs to the generally parallel configuration seen in FIG. 3. The different widths of the legs enable the narrower leg to nest within the wider leg. The bars 42 nest inside the respective channel shapes of the legs. In the collapsed, inoperative state of FIG. 3 it will be appreciated that the machine 10 is extremely compact and can easily be stored in a cupboard or beneath a bed.

In the illustrated embodiment, the legs and support members are pivoted to one another about a common axis. In other versions of the invention, the legs could be independently pivoted to the respective support members, with the support members themselves being pivoted directly to one another. In this event, it is desirable for the various pivotal axes to be close together so that the required parallel or nearly parallel relationship of the legs and support members can still be achieved in the collapsed or inoperative state of the machine.

Figure 4:
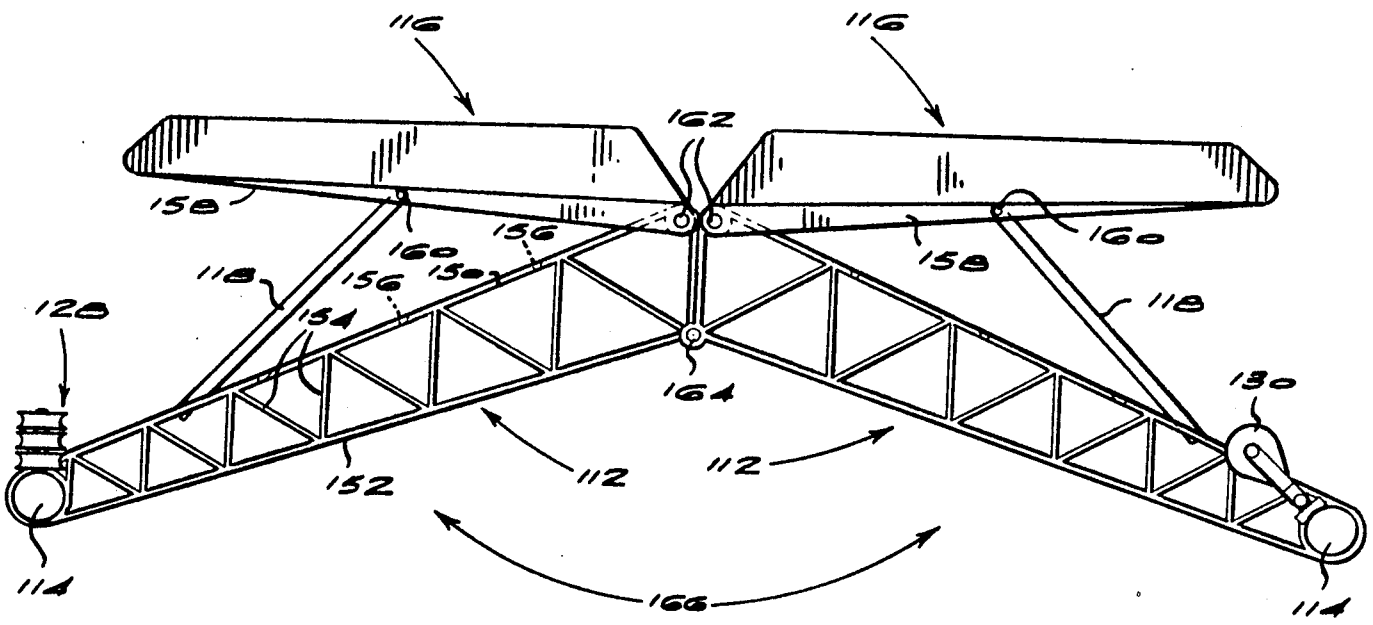
FIG. 4 shows a side view of a second embodiment of the invention, in an operative state.
Figure 5:
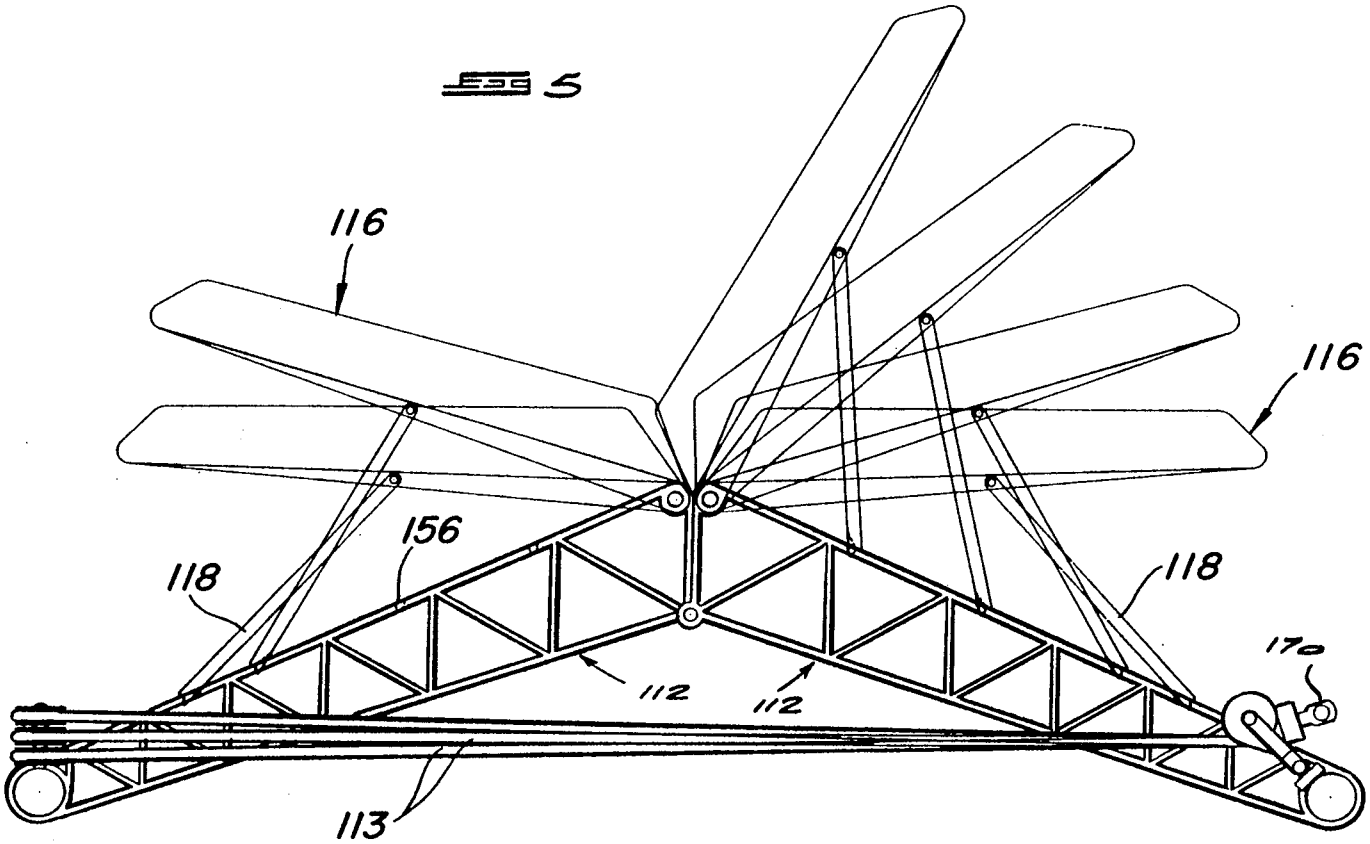
FIG. 5 illustrates the versatility of the second embodiment.
Figure 6:
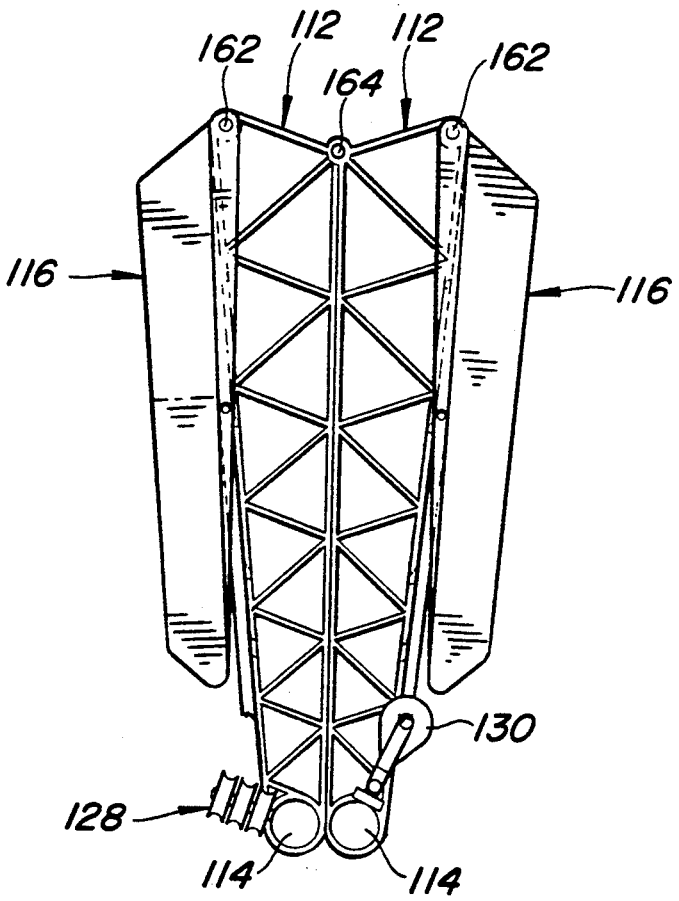
FIG. 6 shows a side view of the second embodiment, folded to an inoperative state.

FIGS. 4 to 6 illustrate a second, preferred embodiment of the invention. In these Figures, components corresponding to those of the previous Figures are indicated with the same reference numerals prefixed with the numeral "1".

In the second embodiment, the legs 112 are of moulded plastics construction and have upper and lower flanges 150, 152 and an array of connecting webs 154 extending between them. The upper flanges 150 are formed with spaced apart recesses 156 to receive the lower ends of the stays 118. The upper ends of the stays 118 are pivoted to the moulded plastics bases 158 of the support members 116 at pivot points 160. As in the previous embodiment, the support members 116 have padded upper surfaces.

The bases 158 of the support members 116 are connected pivotally to upper corners of the legs 112 by means of pivot pins 162. This is achieved by intercalating annular formations of the legs and support members and then inserting the pivot pins through the aligned apertures of the intercalated formations.

Lower corners of the legs 112 are pivoted to one another using a pivot pin 164 and a similar arrangement of intercalated, annular formations. It will be appreciated that with the illustrated geometry of the legs 112, they cannot pivot apart, in the direction indicated by the arrow 166, any further than is illustrated in FIGS. 4 and 5. However, the legs 112 can be pivoted together to a substantially parallel relationship, as illustrated in FIG. 6, when the exercising machine is to be stored compactly.

Referring to FIG. 6, it will be seen that the pivotal connections achieved by the pins 162 allow the support members to be folded to orientations in which they too are substantially parallel to the legs 112. Thus, in the inoperative state, the fully folded machine is extremely compact. Also, being primarily of moulded plastics construction, it is extremely light and easily transported.

In this embodiment, the transverse feet 114 of the legs 112 are provided by integrally moulded tubular members. In a manner similar to the first embodiment, the feet 114 carry pulley blocks 128, 130, providing three pulleys each, about which resistance elements, once again in the form of elastic cords 113 of varying elasticity, pass. The pulley blocks 130 are provided at opposite ends of one of the feet 114 and a single pulley block 128 is located centrally on the other foot 114. The elastic cords are omitted from FIGS. 4 and 6 in the interests of clarity.

The free ends of the cords are fitted with eyes 170, incapable of passing through the various pulleys, to which handles similar to the handles of the first embodiment can selectively be hooked. As before, the user can select between any single cord or any combination of the three cords, depending on the resistance which he wishes to work against when exercising.

Each elastic cord passes from an eye 170, through a pulley of a pulley block 130 at one end of the relevant foot 114, around the appropriate pulley of the pulley block 128, and finally around a pulley of the other pulley block 130 at the opposite end of the relevant foot 114. Thus each cord has generally a V-shape when viewed in plan.

As in the first embodiment, the ankle straps can be hooked to the selected cord(s) in place of handles.

FIG. 5 shows how the support members 116 can be pivoted, independently of one another, to various inclinations, merely by engaging the lower ends of the stays 118 with different recesses 156. For instance, FIG. 4 shows the support members in horizontal, coplanar relationship so that in combination, they provide a flat bench to support the user in a prone position on his back or stomach. Other support member positions illustrated in FIG. 5 can provide various seating arrangements.

As indicated previously, the exercising machine of the invention can be used for a wide variety of exercises. In each case, the user selects the support member orientations by appropriate manipulation of the stays 118, the resistance against which to work by choosing the cord(s), and the use of handles or ankle straps. With the range of choices open to him, and the possible range of limb movements for each choice, the user will be able to exercise, in different ways, numerous parts of the body.

To give a few examples only, the user could, with the support members 116 in the FIG. 4 orientations, lie on his stomach and attach the cord(s) to his ankles using the ankle straps. He can then exercise his leg muscles by alternately bending and relaxing his legs against the resistance of the cord(s). Similarly, lying on his back and using the ankle straps, the user could perform a cycling type exercise. With the seats again in the FIG. 4 position, using the handles, and lying on his back, the user can perform a bench press type exercise by alternately straightening and relaxing his arms, against the resistance of the cord(s), in a vertical direction. With the support members forming a seat and again using the handles, the user can perform a curl type exercise to exercise the biceps by alternately bending and relaxing his arms at the elbows.

It is therefore envisaged that the user can perform an enormous number of useful exercises with a single machine which is of lightweight and simple construction and which can be folded up extremely compactly when not in use.

I claim:

1. An exercising machine comprising support legs, a pair of support members and at least one resistance element made of elastically stretchable material, the legs and support members being pivotally interconnected with one another about a single, common pivotal axis so that the legs are pivotable relative to each other, and the support members are pivotable relative to each other and to the legs in such a manner that the legs and support members are movable between:

a) an operative state in which the legs define a stand and the support members are supported pivotably by the stand, the support members themselves being movable pivotally relative to the stand to various chosen inclinations relative to one another to provide different support configurations for a user, such configurations ranging between a bench configuration in which both support members are substantially horizontal and a seat configuration in which either one of the support members is horizontal to form a seating surface and the other support member is upright to form a backrest; and b) a compact, inoperative state in which the legs and support members are pivoted together so as to be parallel or nearly parallel with one another, and wherein:

c) means are provided to support the support members relative to the stand at each chosen inclination; and d) the at least one resistance element being attached to the stand beneath the support members in such a manner that free ends of the at least one resistance are positioned for manual engagement by a seated or lying user supported by the support members, thereby enabling the user to perform various different exercises by alternately stretching and relaxing the at lest one resistance element against its elasticity.

2. An exercising machine according to claim 1 which there is a pair of legs and in which the legs and support members are pivoted to one another about a single, common, pivotal axis.

3. An exercising machine according to claim 1 which there is a pair of legs and in which the legs are pivoted to one another and the support members are pivoted to the respective legs.

4. An exercising machine according to claim 1 wherein the means to support the support members relative to the stand comprises pivotal stays extending between the support members and the respective legs.

5. An exercising machine according to claim 1 wherein the legs carry transverse, group-engaging feet at their ends.

6. An exercising machine according to claim 1 and including two or more resistance elements in form of elastic bands of varying elasticity.

7. An exercising machine according to claim 6 and including three resistance elements.

8. An exercising machine according to claim 7 and including handles, ankle straps or both which are selectively engageable with any one or more of the elastic bands, thereby to vary the resistance against which the user can exercise.

9. An exercising machine according to claim 1 wherein at least the legs are of moulded plastics construction.

10. An exercising machine according to claim 1 wherein the stand defined by the legs in the operative state of the machine is V-shaped.

11. An exercising machine according to claim 6 wherein the elastic bands are looped around pulleys provided by pulley blocks mounted on the transverse, ground engaging feet.

12. An exercising machine according to claim 6 comprising first and second transverse feet carried respectively by first and second ones of the legs, the first foot carrying spaced apart first pulley blocks adjacent opposite ends thereof and a further pulley block between the first pulley blocks, the second foot carrying spaced apart second pulley blocks adjacent opposite ends thereof, and each elastic band passing sequentially around a pulley of a first pulley block, a pulley of a second pulley block, a pulley of the further pulley block, a pulley of the other second pulley block and a pulley of the other first pulley block, the elastic band thus being arranged to form a W-shape when viewed from above.

13. An exercising machine according to claim 6 comprising first and second ones of the transverse feet carried respectively by first and second legs, the first foot carrying spaced apart first pulley blocks towards opposite ends thereof, the second foot carrying a second centrally located pulley block, and each elastic band passing sequentially around a pulley of a first pulley block, a pulley of the second pulley block and a pulley of the other first pulley block, the elastic element thus being arranged to form a V-shape when viewed from above.

14. An exercising machine according to claim 1 wherein the support members are identical to one another and are padded.

15. An exercising machine according to claim 1 wherein the legs form a downwardly open acute angle when in the operative state, the support members being pivotably mounted at a location adjacent a highest point of the acute angle.

16. An exercising machine according to claim 1 including manually grippable handles connected to tends of at least one resistance element.

17. An exercising machine comprising a pair of support legs, a pair of support members and at least one resistance element made of elastically stretchable material, the legs being pivoted to one another and the support members being pivotally interconnected with one another and to the respective legs so that the legs are pivotable relative to each other, and the support members are pivotable relative to each other and to the legs in such a manner that the legs and support members are movable between:

a) an operative state in which the legs define a stand and the support members are supported pivotably by the stand, the support members themselves being movable pivotably relative to the stand to various chosen inclinations relative to one another to provide different support configurations for a user, such configurations ranging between a bench configuration in which both support members are substantially horizontal and a seat configuration in which either one of the support members is horizontal to form a seating surface and the other support member is upright to form a backrest; and b) a compact, inoperative state in which the legs and support members are pivoted together so as to be parallel or nearly parallel with one another, and wherein:

c) means are provided to support the support members relative to the stand at each chosen inclination; and d) the at least one resistance element being attached to the stand beneath the support members in such a manner that free ends of the at least one resistance element are positioned for manual engagement by a seated or lying user supported by the support members, thereby enabling the user to perform various different exercises by alternately stretching and relaxing the at lest one resistance element against its elasticity.

18. An exercising machine comprising support legs, a pair of support members and at least one resistance element made of elastically stretchable material, the legs and support members being pivotally interconnected with one another so that the legs are pivotable relative to each other, and the support members are pivotable relative to each other and to the legs in such a manner that the legs and support members are movable between:

a) an operative state in which the legs define a V-shaped stand and the support members are supported pivotably by the stand, the support members themselves being movable pivotally relative to the stand to various chosen inclinations relative to one another to provide different support configurations for a user, such configurations ranging between a bench configuration in which both support members are substantially horizontal and a seat configuration in which either one of the support members is horizontal to form a seating surface and the other support member is upright to form a backrest; and b) a compact, inoperative state in which the legs and support members are pivoted together so as to be parallel or nearly parallel with one another, and wherein:

c) means are provided to support the support members relative to the stand at each chosen inclination; and d) the at least one resistance element being attached to the stand beneath the support members in such a manner that free ends of the at least one resistance element are positioned for manual engagement by a seated or lying user supported by the support members, thereby enabling the user to perform various different exercises by alternately stretching and relaxing the at lest one resistance element against its elasticity.

19. An exercising machine comprising support legs, a pair of support members and two or more resistance elements in the form of elastically stretchable bands of varying elasticity, the legs and support members being pivotally interconnected with one another so that the legs are pivotable relative to each other, and the support members are pivotable relative to each other and to the legs in such a manner that the legs and support members are movable between:

a) an operative state in which the legs define a stand and the support members are supported pivotably by the stand, the support members themselves being movable pivotally relative to the stand to various chosen inclinations relative to one another to provide different support configurations for a user, such configurations ranging between a bench configuration in which both support members are substantially horizontal and a seat configuration in which either one of the support members is horizontal to form a seating surface and the other support member is upright to form a backrest; and b) a compact, inoperative state in which the legs and support members are pivoted together so as to be parallel or nearly parallel with one another, and wherein:

c) means are provided to support the support members relative to the stand at each chosen inclination;

d) the at least one resistance element being attached to the stand beneath the support members in such a manner that free ends of the at least one resistance element are positioned for manual engagement by a seated or lying user supported by the support members, thereby enabling the user to perform various different exercises by alternately stretching and relaxing the at lest one resistance element against its elasticity, and e) first and second transverse ground-engaging feet being carried respectively by first and second ones of the legs, the first foot carrying spaced apart first pulley blocks adjacent opposite ends thereof and a further pulley block between the first pulley blocks, the second foot carrying spaced apart second pulley blocks adjacent opposite ends thereof, and each elastic band passing sequentially around a pulley of a first pulley block, a pulley of a second pulley block, a pulley of the further pulley block, a pulley of the other second pulley block and a pulley of the other first pulley block, the elastic band thus being arranged to form a W-shape when viewed from above.

20. An exercising machine comprising support legs, a pair of support members and two or more resistance elements in the form of elastically stretchable bands of varying elasticity, the legs and support members being pivotally interconnected with one another so that the legs are pivotable relative to each other, and the support members are pivotable relative to each other and to the legs in such a manner that the legs and support members are movable between:

a) an operative state in which the legs define a stand and the support members are supported pivotably by the stand, the support members themselves being movable pivotally relative to the stand to various chosen inclinations relative to one another to provide different support configurations for a user, such configurations ranging between a bench configuration in which both support members are substantially horizontal and a seat configuration in which either one of the support members is horizontal to form a seating surface and the other support member is upright to form a backrest;

b) a compact, inoperative state in which the legs and support members are pivoted together so as to be parallel or nearly parallel with one another, and wherein:

c) means are provided to support the support members relative to the stand at each chosen inclination;

d) the at least one resistance element being attached to the stand beneath the support members in such a manner that free ends of the at least one resistance element are positioned for manual engagement by a seated or lying user supported by the support members, thereby enabling the user to perform various different exercises by alternately stretching and relaxing the at lest one resistance c'ement against its elasticity, and e) first and second transverse feet carried respectively by first and second legs, the first foot carrying spaced apart first pulley blocks towards opposite ends thereof, the second foot carrying a second centrally located pulley block, and each elastic band passing sequentially around a pulley of a first pulley block, a pulley of the second pulley block and a pulley of the other first pulley block, the elastic element thus being arranged to form a V-shape when viewed from above.

* * * * *